United States Patent [19]

Vulcano

[11] 4,349,199

[45] Sep. 14, 1982

[54] RACQUET HANDLE

[76] Inventor: Richard Vulcano, 235 Keith Rd., West Vancouver, British Columbia, Canada

[21] Appl. No.: 249,966

[22] Filed: Apr. 1, 1981

[30] Foreign Application Priority Data

Oct. 6, 1980 [CA] Canada ..... 361627

[51] Int. Cl.[3] ..... A63B 49/08

[52] U.S. Cl. ..... 273/75; 273/76

[58] Field of Search ..... 273/67 R, 67 A, 67 D, 273/67 DA, 73 R, 73 J, 75, 76, 81 R, 81 B, 81.3, 81.4, 326; 145/29 R, 61 R, 61 C; 43/23

[56] References Cited

U.S. PATENT DOCUMENTS

| | | | |
|---|---|---|---|
| D. 177,694 | 5/1956 | Plumb et al. | 145/61 R X |
| 1,677,099 | 7/1928 | Harness | 273/81 B |
| 2,280,302 | 4/1942 | Davis | 273/75 |
| 3,206,204 | 9/1965 | Lacoste | 273/75 |
| 3,545,755 | 12/1970 | Owada | 273/76 X |
| 4,072,312 | 2/1978 | Kahn | 273/75 |
| 4,147,348 | 4/1979 | Lee | 273/75 X |
| 4,183,528 | 1/1980 | An | 273/75 |

FOREIGN PATENT DOCUMENTS

| | | | |
|---|---|---|---|
| 1053281 | 4/1979 | Canada | 273/75 |
| 2407725 | 7/1979 | France | 273/76 |
| 17802 | of 1913 | United Kingdom | 273/81 B |
| 229174 | 2/1925 | United Kingdom | 273/73 J |
| 362604 | 12/1931 | United Kingdom | 273/81 B |

*Primary Examiner*—Anton O. Oechsle

*Attorney, Agent, or Firm*—Browdy and Neimark

[57] ABSTRACT

A racquet or bat for tennis, racquet ball and like games having a planar striking face carried by a handle. The handle has parallel longitudinally extending surfaces positioned normal to the plane of the striking face, and a pair of longitudinally extending relatively angled surfaces which are each inclined at equal acute angles with respect to the plane of the striking face.

5 Claims, 5 Drawing Figures

RACQUET HANDLE

The present invention relates to a sports racquet or bat for playing games such as tennis, badminton, squash, racketball, table tennis and the like, and particularly relates to a handle for such a racquet.

A main purpose of the present invention is to provide a racquet handle providing maximum racquet control and proper stroke orientation, and which is of a configuration that the player can immediately determine by racquet hand feel alone the precise orientation of the ball-striking surface thereby avoiding the necessity of the player having to constantly re-position the racquet in his hand to provide proper alignment of the playing surface with the hand and wrist.

The handle according to the present invention is useful with racquets made with any of the common materials, wood, fiberglass, carbon, and metal, but the inventive concept has particular application to racquets having head frames made of metal material. In a practical general sense, a player's "feel" for the ball is essential, and it is known that the use of metal racquets tends to diminish this "feel" and it has been professionally established under playing conditions that a metal frame racquet having a handle in accordance with the present invention results in less vibration than normal metal racquets consequently reducing possible damage to the arm and elbow. It has also professionally been found when using the handle according to the invention that the hand tends to relax significantly and the user appreciates a control of the racquet which is not apparent when using racquets having handles which are substantially symmetrical in cross-section or of other known configurations.

DISCUSSIONS OF THE PRIOR ART

Prior patents known to applicant relating to racquets and handles for racquets which seek to provide racquet control and player feel are:

Canadian Pat. No. 1,053,281, issued Apr. 24, 1979, to Frank G. Hollendorfer;

U.S. Pat. No. 2,280,382, granted Apr. 21, 1942, to T. A. Davis;

U.S. Pat. No. 3,206,204, granted Sept. 14, 1965, to J. R. Lacoste;

U.S. Pat. No. 3,545,755, granted Dec. 8, 1970, to H. Owada;

U.S. Pat. No. 4,072,312 granted Feb. 7, 1978, to B. Kahn;

U.S. Pat. No. 4,147,348, granted Apr. 3, 1979, to J. K. Lee;

U.S. Pat. No. 4,183,528 granted Jan. 15, 1980, to B. J. An.

Various attempts have been made to provide a sports racquet, and particularly a handle for such a racquet affording a comfortable grip while at the same time providing a handle configuration which is adapted to resist turning or slipping of the handle during stroking of a game ball. Racquet-ball games are all of the strenuous variety, and during play, the formation of perspiration and moisture on the hand of the player lessens the frictional contact between hand and racquet handle and upon impact with the ball, the racquet tends to turn in the hand of the user, and this is particularly true when the ball is struck off-centre. Many racquet handles with which applicant is familiar all have a configuration which is octagonal, circular, or otherwise generally symmetric about a central axis as shown in Canadian Pat. No. 1,053,281, and U.S. Pat. Nos. 2,280,382 and 3,206,204. These patents are also concerned with providing a handle with non-slip surfacing to resist turning or slipping.

With these known racquets which are symmetrical about a central axis, it is not possible, by hand feel alone for a player to determine the precise orientation of the playing face of the racquet without determining this visually or by placing the racquet against another portion of the body such as the other hand or a leg or the like. With such racquets, however, and during strenuous play, a racquet may turn from its position or original orientation and as the player is concentrating on the next stroke of the ball, it often happens that the playing face of the racquet is improperly oriented with respect to the hand and wrist of the player with the result that an incorrect shot is made.

U.S. Pat. Nos. 3,545,755; 4,147,348, 4,183,528 provide handles having off-set or pistol-type grips for racquet control and feel. These arrangements, however, are of extremely specialized design which have not found general acceptance which is possibly because the handles are gripped in such non-conventional fashion.

U.S. Pat. No. 4,072,312 provides a racquet handle of the generally symmetrical variety provided with pairs of parallel normally oriented surfaces of differing size so that proper racquet orientation can be determined by hand feel alone. However, to avoid against rotation and slippage the patentee provides concave grooves in the basically parallel surfaces which are covered with non-slip surfacing. With this arrangement, and to prevent rotation a firm and tiring grasp is required in contrast to the handle of the present invention which can easily be held without strain while still resisting rotation and slippage.

Many prior racquet handles seek to avoid slippage and turning in the hand by the use of friction type surfaces such as elastomeric and rubber material, whereas it has been found that due to the present novel configuration and regardless of surface material, the incidence of slipping or turning of the racquet in the hand even after strenuous activity are substantially eliminated.

THE PRESENT INVENTION

These advantages are achieved by the present invention which provides a natural grip for the player's hand, and which when the handle becomes moistened during use resists turning or slipping or otherwise rotating of the handle in the hand.

These advantages are obtained by the present invention which provides a racquet or bat for tennis, badminton, squash, racquetball, table tennis and like games which have a planar striking face extending from a handle, the handle comprising parallel longitudinally extending surfaces positioned normal to the plane of the striking face, and a pair of longitudinally extending relatively angled surfaces, the angled surfaces being inclined at equal acute angles with respect to the plane of the face.

In a preferred construction, the handle is basically trapezoidal in cross-section with parallel longitudinal surfaces normal to the plane of the striking face, and a pair of longitudinal relatively angled surfaces angled at equal angles with respect to the plane of the striking face.

In a further embodiment, the present invention relates to a racquet or bat for tennis, badminton, squash, racquetball, or like game having a frame defining a planar striking face and a handle secured to and extending from the frame, the handle comprising parallel longitudinally extending surfaces positioned normal to the plane of the face, and a pair of relatively angled surfaces, each angled surface being inclined at equal acute angles with respect to the plane of the face.

In a preferred construction, the angled surfaces are each inclined with respect to the plane of the playing face at equal angles in a range of about 5° to about 10°, preferably 7°–8°.

In a still further embodiment, the equal acute angles of the handle as above described are in the range of 40°–50°.

BRIEF DESCRIPTION OF ACCOMPANYING DRAWINGS

The inventive concept will now be more fully described with reference to the accompanying drawings wherein.

DETAILED DESCRIPTION OF ACCOMPANYING DRAWINGS

Figure 1:
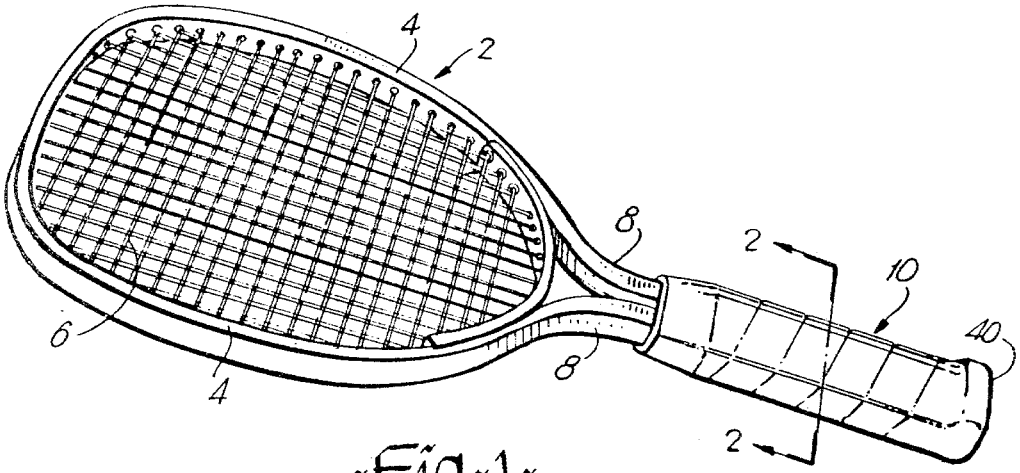
FIG. 1 illustrates in perspective view a racquet having a handle in accordance with the present invention.

Reference will now be had to the accompanying drawings wherein like reference numerals refer to like parts.

The racquet as shown in FIG. 1 consists of a head 2 consisting of a frame 4 carrying strings 6 in conventional fashion providing a planar ball-striking surface. The legs 8 of the frame extend into and are carried by a racquet handle generally indicated by numeral 10.

Figure 2:
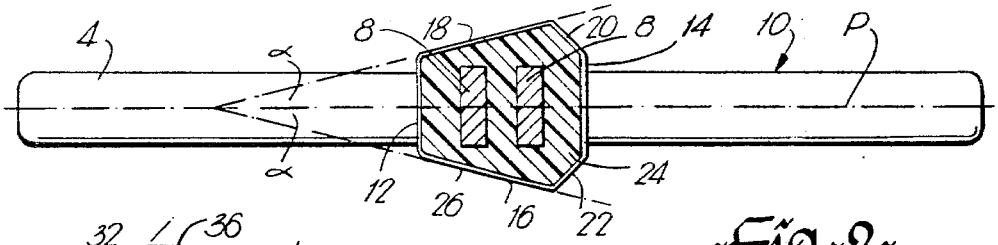
FIG. 2 is a sectional view of one embodiment of the present invention taken along line 2—2 of FIG. 1.

FIG. 2 is a sectional view taken along line 2—2 of FIG. 1, and reference line P represents the plane of the ball-striking surface of head 2. The handle 10 in cross-section as shown in FIG. 2 can be considered as being generally of trapezoidal configuration having two longitudinal parallel surfaces 12, 14, and two relatively tapered or inclining surfaces 16, 18. The planes of the parallel surfaces 12, 14 are normal to the plane P of the striking surface whereas the planes of the tapering or inclining surfaces 16, 18 angle acutely (and identically) with respect to the plane P of the playing surface as shown by angles $\alpha$ in FIG. 2.

The dictionary definition of trapezoid is a quadrilateral having two parallel sides. In present context, however, the word trapezoid and the terminology "generally trapezoidal configuration" is sometimes used as a means for defining the cross-section configuration shown in FIG. 2 as this section comprises four major surfaces 12, 14 and 16, 18 and two minor surfaces 20, 22, which could in actual practice be rounded as opposed to the flat surfaces as shown in FIG. 2 without departing from the inventive concept.

The legs 8 of the frame 4 extend into the handle 10 as shown in FIG. 2, and the handle itself may be molded plastic or foam filled or the like as shown at 24, surrounded by a suitable covering such as tape 26.

Figure 3:
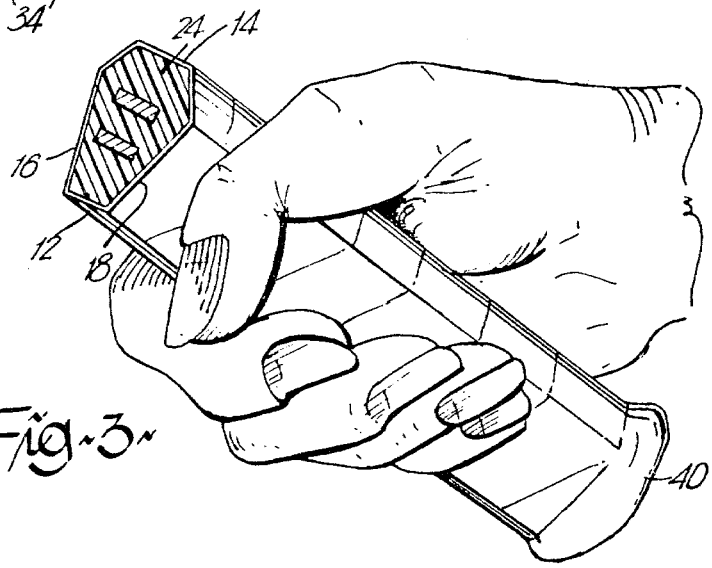
FIG. 3 is a perspective view of a handle design in accordance with the showing in FIGS. 1 and 2 positioned within the hand of a user.

In use, the handle of FIG. 2 is grasped in a manner as shown in FIG. 3, with the larger 14 of the parallel surfaces positioned in the palm of the hand and with the fingers encircling the narrower portion 12 of the parallel surfaces of the handle. It has been found that the present handle configuration provides for a very precise and relaxed grip and provides the user with a comfortable grip and one which does not have a tendency to turn in the hand as a result of striking a ball.

This handle configuration has a very definite feel and the user upon picking up the racquet with one hand and not inspecting the racquet visually can determine precisely the orientation of the playing surface with respect to his wrist.

This positioning of the handle within the hand of the user results in the playing face always being in a natural correct position normal to the trajectory of the ball whether the player is striking a forehand or backhand stroke.

Figure 4:
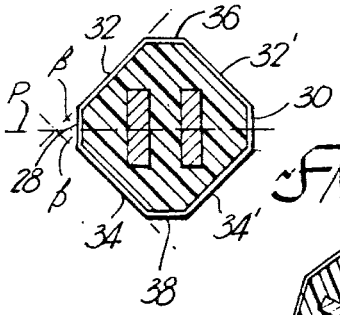
FIG. 4 is a cross-sectional view of a further embodiment of a handle according to the present invention.

A further embodiment of the handle according to the present invention is illustrated in FIG. 4, and this handle also has parallel surfaces 28, 30 positioned normal to the plane P of the playing surface. This handle also has major planar surfaces 32, 34 tapering or inclining obliquely with respect to the plane P at acute angles as shown at $\beta$ but angles $\beta$ are greater than the angles $\alpha$ as shown in FIG. 2. In preferred construction, the angles $\alpha$ in FIG. 2 are in the range of 5° to 10°, preferably 7°–8°, and the angles $\beta$ in FIG. 3 are of the order of about 40° to 50° preferably about 45°.

In other words and with respect to the embodiment shown in FIGS. 1, 2 and 3, the pair of relatively angled major surfaces 16 and 18 are inclined with respect to minor surface 12 (which is normal to the plane of the striking face) at equal angles in the range of about 95° to 100°, preferably 97° to 98°.

The handle in FIG. 4 also has a further pair of major planar surfaces 32', 34' which are relatively inclined and their planes meet plane P at an angle similar to angle $\beta$. Parallel surfaces 36, 38 in FIG. 4 may be of rounded configuration.

The cross-sectional configurations of FIGS. 2 and 4 extend longitudinally substantially the entire length of handle 10 and may extend the complete length. In preferred construction, however, the end 40 (FIGS. 1 and 3) of the handle is somewhat enlarged and more rounded to assist in preventing the handle from movement in the hand in longitudinal direction.

The forward end of the handle 42 (FIG. 1) may have a generally truncated pyramidal configuration as shown.

I claim:

1. In a racquet or bat for tennis, badminton, squash, racquetball, table tennis and like games having a planar striking face extending from a handle, the improvement wherein said handle comprises: first and second parallel longitudinally extending minor surfaces positioned, in transverse cross-section, normal to the plane of the striking face; and a pair of longitudinally extending relatively angled major surfaces which, in transverse cross-section, are inclined with respect to said first normally positioned minor surface at equal angles in the range of about 95° to 100°.

2. A racquet or bat for tennis, badminton, squash, racquetball, table tennis or like games comprising a frame defining a planar striking face and a handle secured to and extending from said frame, wherein said handle comprises:

first and second parallel longitudinally extending minor surfaces positioned, in transverse cross-section, normal to the plane of said face;

a pair of longitudinally extending relatively angled major surfaces which, in transverse cross-section, are inclined with respect to said first normally positioned minor surface at equal angles in the range of about 95° to 100°; and a further pair of longitudinally extending relatively angled planar minor surfaces, each extending, in transverse cross-section, between said second normally positioned minor surface and a respective one of said major surfaces at the end thereof furthest from said first normally positioned minor surface.

3. A racquet according to claim 1 or claim 2, wherein said equal angles are in the range of 97° to 98°.

4. A racquet in accordance with claim 1, further including a further pair of longitudinally extending relatively angled planar minor surfaces, each extending, in transverse cross-section, between said second normally positioned minor surface and a respective one of said major surfaces at the end thereof furthest from said first normally positioned minor surface.

5. A racquet according to claim 2, wherein the frame is of metal material.

* * * * *